United States Patent [19]

Tyler

[11] 4,031,875

[45] June 28, 1977

[54] FUEL VAPORIZER

[76] Inventor: Darwin A. Tyler, 26054 East St. U12, Llano, Calif. 93544

[22] Filed: Sept. 15, 1975

[21] Appl. No.: 613,057

[52] U.S. Cl. ..... 123/141; 261/DIG. 55; 48/180 R; 123/122 A

[51] Int. Cl.[2] ..... F02M 29/00

[58] Field of Search ..... 48/180 R; 123/141, 122 A, 123/122 B; 261/DIG. 55, 21

[56] References Cited

UNITED STATES PATENTS

| | | | |
|---|---|---|---|
| 1,473,349 | 11/1923 | Kach | 418/180 R |
| 1,481,792 | 1/1924 | Dailey | 48/180 R |
| 1,519,371 | 12/1974 | Farnsworth | 48/180 R |
| 2,543,105 | 2/1951 | Harrison | 48/180 R |
| 2,588,474 | 3/1952 | Bellios | 123/141 |
| 3,762,385 | 10/1973 | Hollnagel | 123/122 A |

*Primary Examiner*—Ronald H. Lazarus
*Attorney, Agent, or Firm*—John H. Crowe

[57] ABSTRACT

A device for vaporizing the gasoline droplets in air-fuel mixtures from conventional carburetors to improve fuel combustion in internal combustion engines. The device has a relatively thin, box-shaped body enclosing flat upper and lower chambers separated by a thin aluminum partition, the chambers being of equal size and shape. The body has an opening in its top into the upper chamber, offset from the longitudinal center of the chamber, and an aligned opening in its bottom, and is designed for installation between the carburetor and intake manifold of an internal combustion engine. The thin aluminum partition has two transverse slots, one offset in one longitudinal direction and the other offset in the other longitudinal direction from the aligned openings in the body of the device. When the device is in use, air-fuel mixtures from the carburetor pass into the upper chamber from the opening in its top, where they are deflected in the direction of one or both of the transverse slots. The mixtures then pass through the lower chamber and are drawn through the bottom opening of the device into the intake manifold of the engine. The somewhat tortuous progression of the air-fuel mixtures through the vaporizing device subjects them to conditions conducive to vaporization of the gasoline droplets in the mixtures prior to the time they enter the intake manifold.

5 Claims, 5 Drawing Figures

FIG. 1.
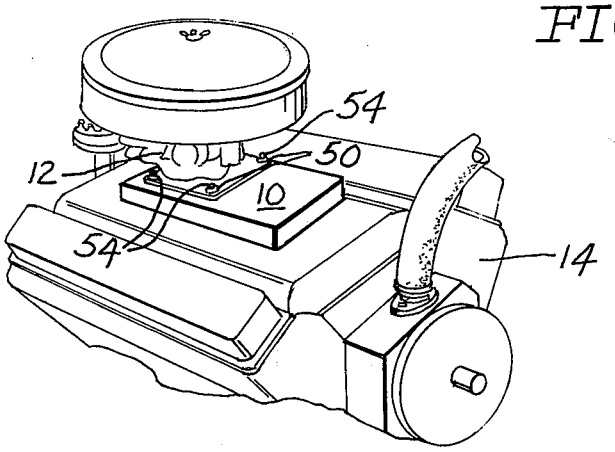
FIG. 2.
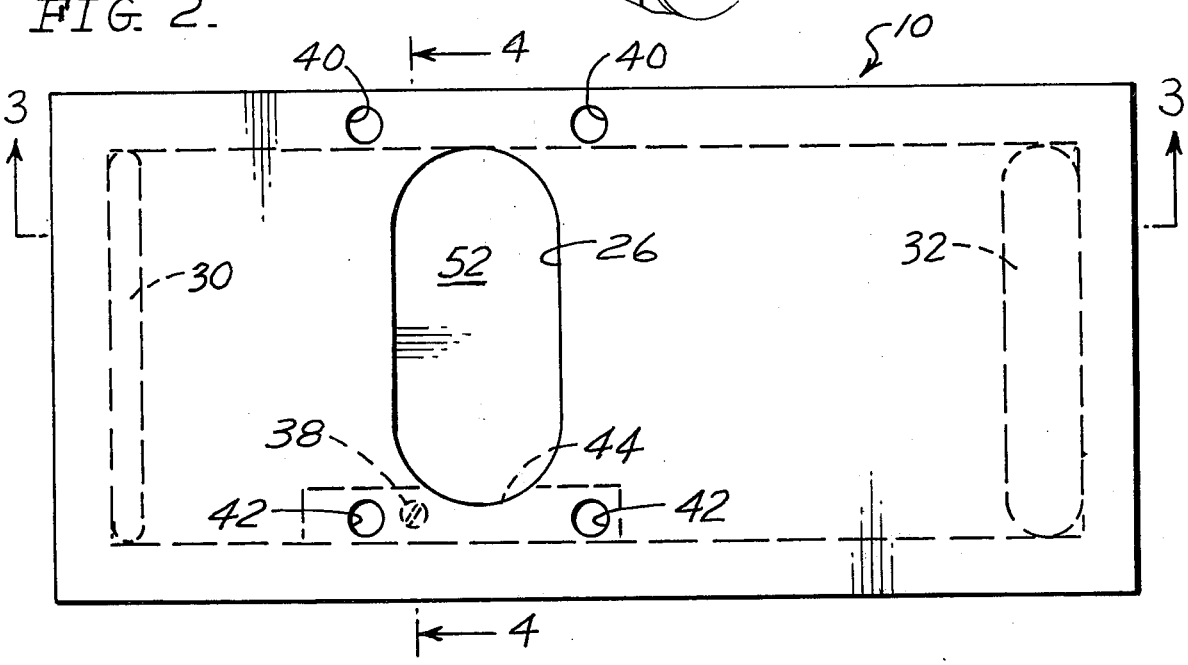
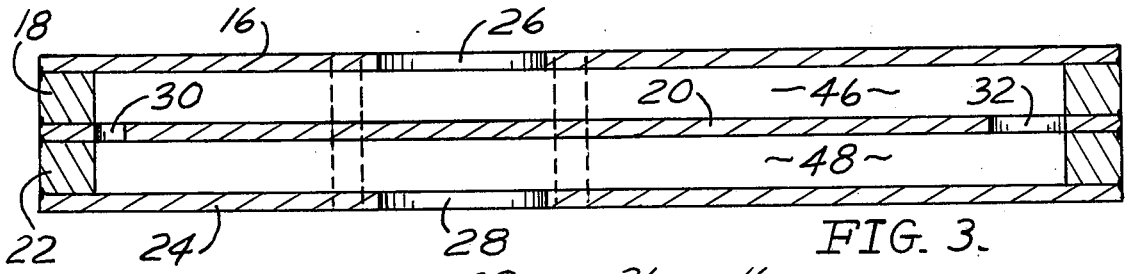
FIG. 3.
FIG. 4.
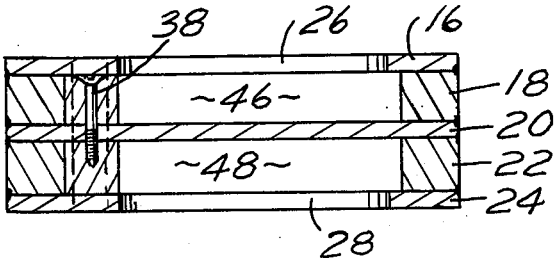

FUEL VAPORIZER

BACKGROUND OF THE INVENTION

The present invention relates generally to fuel induction systems for internal combustion engines, and more particularly to vaporizer means for converting wet mixtures of gasoline and air from conventional carburetors into dry mixtures of gasoline vapor and air for purposes of improved gasoline combustion and cleaner engine exhausts.

It is well known that gasoline fuel burns most efficiently in an internal combustion engine when it is in the form of a vapor. The conventional carburetor does not convert all of the gasoline passing therethrough into vapor, a substantial portion being, instead, merely broken up into tiny droplets that remain suspended in the intake air when the resulting mixture is drawn through the manifold and into the cylinders of an engine. While some vaporization takes place, a substantial portion of the gas remains in the form of liquid droplets in the cylinder head at the time the mixture is ignited by the spark. These liquid fuel droplets burn inefficiently, or incompletely, with the result that the engine exhaust contains an excessive amount of unburned hydrocarbons and carbon monoxide as air pollutants which contribute to the formation of atmospheric smog. Nitrogen oxide is also formed, as a smog-producing pollutant in the exhaust, because of high combustion temperatures in the engine, particularly at the point where the exhaust gases pass through the exhaust ports during the first few degrees of valve opening. These high temperatures are brought about when minute droplets of liquid fuel, still unburned, are vaporized by the heat of combustion to mix with the remaining oxygen, so that afterwards there is delayed combustion at an exceedingly high temperature when the gas is passed between the face of the valve and the valve seat. This high temperature is responsible for formation of the nitrogen oxide found in internal combustion engine exhaust gases.

In addition to the above-noted disadvantages of the incomplete combustion of gasoline brought about by incomplete vaporization thereof in carburetors, there is a further disadvantage in the face that such incomplete combustion results in deposits of carbon on interior engine surfaces. Furthermore, incomplete fuel combustion is wasteful of energy, a serious enough problem in the past but one which is now approaching catastrophic proportions because of oil shortages in this country and the rising price of imported oil from the oil-producing nations.

There has been considerable research and development over the years in attempts to modify carburetor-equipped engines for purpose of achieving better fuel economy. In more recent years, such research and development has been accelerated in hopes of finding some means of lowering the output of pollutants in automobile engine exhausts. In still more recent years, the oil shortage crisis has prompted still further efforts to produce carburetor-equipped engines capable of getting more miles per gallon of fuel than do conventional engines. In spite of all these attempts to improve the fuel burning efficiency of internal combustion engines, no means of achieving this objective has, to my knowledge, yet met with widespread commercial acceptance. While various engine attachments for use in conjunction with carburetors for the vaporization of fuel have been heretofore proposed, and even patented, none is in widespread usage by the automobile industry (or anyone else) insofar as I am aware. In view of the critical need today for more efficient fuel burning engines, the absence of such widespread usage of any fuel vaporization means heretofore known is clear evidence that no such means capable of meeting the stringent demands of the marketplace have been provided prior to my invention. The main purpose of the invention is to fill the long existing need for such fuel vaporization means.

SUMMARY OF THE INVENTION

I have now provided, in the novel fuel vaporizer of this invention, a simple, inexpensive, lightweight device that can be easily installed for use between the carburetor and intake manifold of a conventional internal combustion engine. The device, in its preferred form, is essentially a relatively flat housing of a thermally conductive material having an internal arrangement of chambers and ports for the routing of air-fuel mixtures from the carburetor to the intake manifold through a pathway, or pathways, adapted to cause lowering of pressure in the mixtures while they are absorbing heat from the housing under conditions of delayed flow through the carburetor and intake manifold, and thereby convert the mixtures from wet to substantially dry form for combustion in the engine cylinders.

In a preferred method of assembly, the vaporizer is formed from five relatively flat aluminum members of rectangular periphery sized to fit flush against one another and form an elongate structure in the shape of a rectangular parallelepiped. The extreme outer ones of the five members are fairly thin plates, constituting top and bottom members of the assembled vaporizer device. The center member is also a relatively thin plate. Interposed between the center and top and bottom members, respectively, are two relatively thick framelike members which define large openings of rectangular shape. The top and bottom members have transversely extending, axially aligned openings of equal size and shape for receiving air-fuel mixtures from said carburetor and discharging the mixtures, after they have passed through the vaporizer, into said intake manifold. These openings are positioned to one side of a transverse centerline through the device, as seen from the top. The center member has two transverse ports of slotted configuration near its ends, the port closer to the openings in the top and bottom members being narrower than the port farther removed from those openings.

The design of the five aluminum members is such that when they are fitted flush against each other to form the vaporizer housing, upper and lower chambers are created by the large rectangular openings in the framelike members, the center member (which serves as a partition between the two chambers) and the top and bottom plate members, respctively, which chambers are interconnected by the two slotted ports in the center member. When the vaporizer is functioning on an engine running at cruising speed, the air-fuel mixtures from the carburetor first enter the upper chamber, where they are detoured toward the ports in the center member. From the ports the mixtures flow to the discharge opening in the bottom member and into the intake manifold of the engine. Because of their indirect manner of progression from the carburetor to the intake manifold, the air-fuel mixtures are delayed in their travel toward said manifold to give fuel droplets therein time to vaporize to some extent before reaching the manifold. Also, the slot-like ports in the partition separating the upper and lower chambers of the device serve as restrictions in the flow path of the air-fuel mixtures, thus causing the mixtures to accelerate in velocity, and thereby experience pressure drops, when they pass through the ports. The lowered pressures in the mixtures bring about increased vaporization of the fuel droplets therein. Finally, the aluminum parts of the vaporizing device are highly heat conductive, with the result that heat from the intake manifold of the engine travels through the vaporizer structure, and from there into the air-fuel mixtures to accelerate the vaporization of the fuel droplets to an even greater extent. As a result of these time, pressure and heat conditions to which the air-fuel mixtures are subjected, substantially all of the gasoline droplets in the mixtures are vaporized by the time they are fed into the intake manifold of the engine.

It is thus a principal object of this invention to provide simple, inexpensive means for achieving more complete combustion of fuel in internal combustion engines than is possible with conventional carburetion systems of the type now in use on such engine.

It is another object of the invention to provide simple, economical means for subsantially reducing the air pollutant content of internal combustion engine exhausts to bring about a reduction to atmospheric smog.

It is yet another object of the invention to provide such means in a structural form capable of relatively easy incorporation in a conventional internal combustion engine system.

Other objects, features and advantages of the invention will become apparent in the light of subsequent disclosures herein.

BRIEF DESCRIPTION OF THE DRAWINGS

FIG. 1 is a perspective view of a fuel vaporizer of preferred form in accordance with this invention installed for use on an internal combustion engine.

FIG. 2 is an enlarged plan view of the fuel vaporizer shown free of attachment to the internal combustion engine.

FIG. 3 is a longitudinal sectional view of said vaporizer taken along line 3—3 of FIG. 2.

FIG. 4 is a cross-sectional view of the vaporizer taken along line 4—4 of FIG. 2.

DESCRIPTION OF PREFERRED EMBODIMENT

Figure 5:
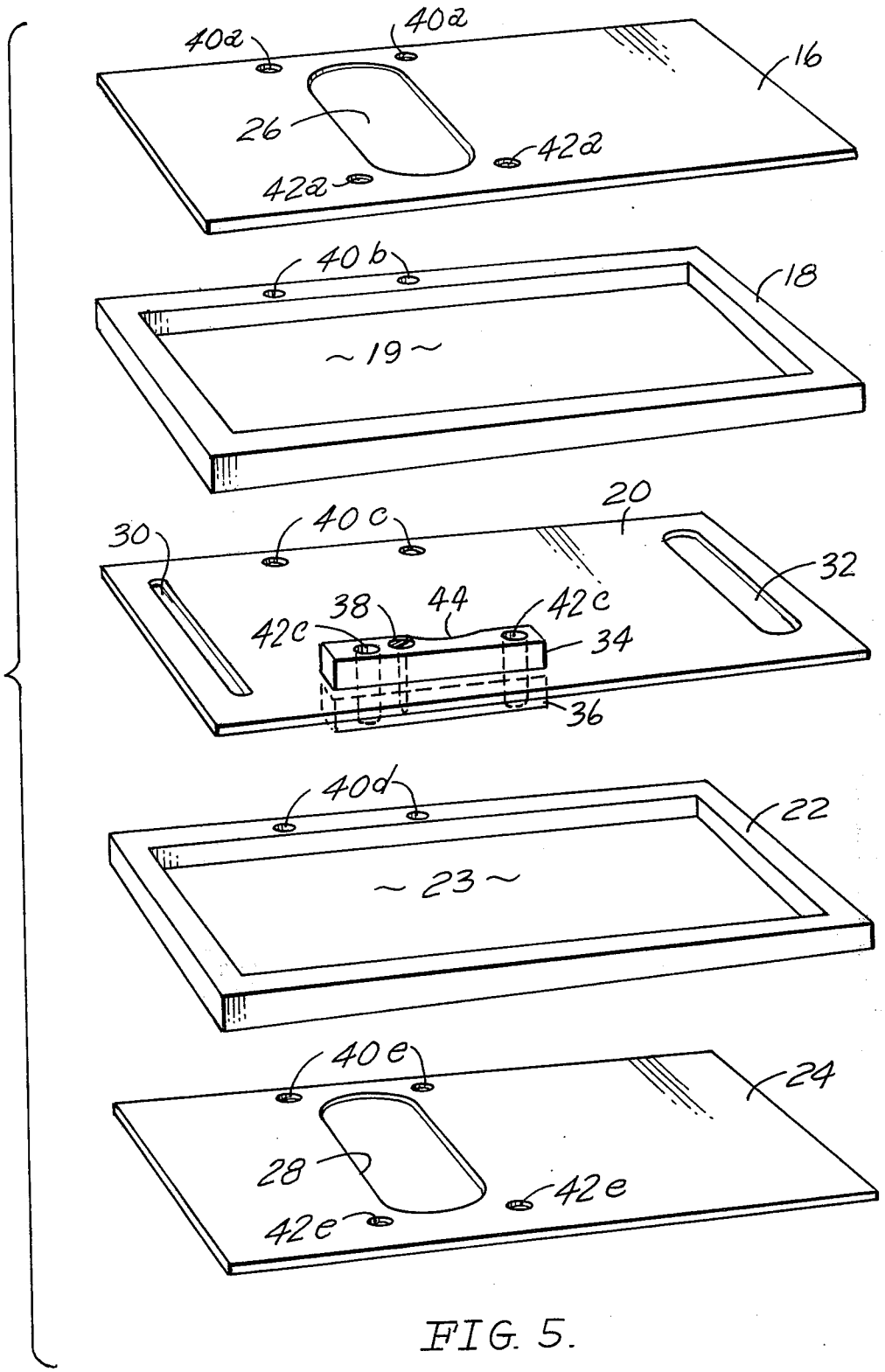
FIG. 5 is an exploded perspective view of the component parts from which the vaporizer is formed, the parts being drawn to a reduced scale.

Considering now the drawings in greater detail, with emphasis first on FIG. 1, there is shown generally at 10 a preferred form of fuel vaporizer in accordance with this invention installed for use between a carburetor 12 and the intake manifold of an internal combustion engine 14. Fuel vaporizer 10 is a device formed from five members of generally flat configuration and rectangular shape adapted to fit flush against each other around their edges to form a structure with a unique arrangement of internal chambers and ports, soon to be described, and having the external shape of a rectangular parallelepiped. These members are formed of a suitable metal, aluminum being preferred because of its relatively light weight, high strength, toughness and good heat conductivity, although any other material suitable for the purpose (metal or otherwise) could be used in lieu of aluminum if desired.

The five members from which fuel vaporizer 10 is formed comprise a relatively thin top plate 16, a bottom plate 24 of substantially the same thickness as the top plate, a center plate 20, again of substantially the same thickness as the top plate, and a pair of identical frame members 18 and 22 interposed between center plate 20 and top and bottom plates 16 and 24, respectively, in the assembled unit. The frame members 18 and 22 are relatively thick, by comparison with the top, bottom and center plates, and each serves to define a large window-like opening, the opening for top frame member 18 being shown at 19, and that for bottom frame member 22 at 23, in FIG. 5. The top plate 16 has a fairly large opening 26 therethrough between its center and one end, and bottom plate 24 has an opening 28 therethrough of the same size and shape as opening 26 and positioned so as to be in alignment with the latter in the assembled vaporizer. As the drawings, and in particular FIGS. 3 and 4, illustrate, upper and lower chambers 46 and 48 are formed in fuel vaporizer 10 by the openings 19 and 23 in upper and lower frame members 18 and 22. These chambers are separated by the center plate 20, which thus serves as a partition therebetween. Extending transversely across center plate 20, at the longitudinal extremes of that plate portion within the "sight" of the top and bottom frame members, are a pair of slotted ports 30 and 32, respectively. Port 30 is seen to the left in FIG. 5, and, as that figure illustrates, is situated closer to the axes of the aligned openings 26 and 28 in the top and bottom plates than is port 32. I have discovered, from extensive experimentation, that a fuel vaporizer such as that illustrated in the drawings is most effective for use on my car (a 1969 Dodge Coronet) where the port 30 is roughly half the width of port 32, and spaced roughly half the distance from the axes of the top and bottom openings 26 and 28 that port 32 is spaced.

Fuel vaporizer 10 is assembled from the five members described above by positioning those members in the vertical order illustrated in FIG. 5, and bringing them together in proper alignment to permit the top and bottom plates to sandwich the three intermediate members. The five members are then fastened tightly together by welding means, not shown, in such fashion as to seal the upper and lower chambers 46 and 48 against fluid leakage. A pair of upper and lower spacers 34 and 36, respectively, are fastened either side of the center plate 20 by means of a screw 38, in the manner illustrated in FIGS. 4 and 5, primarily to provide insurance against the inward buckling of the top of the fuel vaporizer while it is being installed for use. These spacers can be made of the same material as the other parts of fuel vaporizer 10, or of a different material so long as it is suitable for the purpose. They are machined to vertical dimensions the same as the thickness of frame members 18 and 20, so as to fit snugly within the upper and lower chambers without imposing any strain on the vaporizer structure. The inwardly facing sides of spacers 34 and 36 are arcuately indented in the manner shown at 44 in FIGS. 2 and 5 so that they do not block any part of the openings 26 and 28 into chambers 46 and 48 of the vaporizer. The upper surface of spacer 34 is countersunk to receive the head of screw 38, for the obvious purpose of preventing the screw head from interfering with proper assembly of the fuel vaporizer device.

Fuel vaporizer 10 is designed for installation between the carburetor and intake manifold of an internal combustion engine in the manner illustrated in FIG. 1. As will be apparent from the foregoing, and FIG. 1, the vaporizer device is installed with the opening 28 in its bottom plate positioned over the intake manifold of the engine 14 and the opening 26 in its top plate under the discharge opening in the bottom of the carburetor. The carburetor and vaporizer device 10 are anchored in position by means of four studs 54, which are threaded into the regular bores for receiving the mounting studs for the carburetor in its normal position of use on the engine. The studs pass upwardly from these bores to aligned openings in the intervening parts of fuel vaporizer 10 and the mounting holes in the bottom part of the carburetor, and are fastened tightly in position by means of four nuts 50. The bore holes through the vaporizer for two of the studs can be seen at 40, and for the other two studs at 42, on FIG. 2. FIG. 5 shows increments of these four holes on the separate parts of the vaporizer, the increments of bore hole 40 being shown at 40*a* through 40*e*, and for bore hole 42 at 42*a*, 42*c* and 42*e*, thereon.

As will perhaps be evident from the foregoing, I have constructed a vaporizer of substantially the same design as fuel vaporizer 10 and installed it on my personal car (an 8-cylinder, 1969 Dodge Coronet with a two-barrel carburetor which has about 105,000 miles on it) for testing and use. The results of the testing indicated a remarkable increase in fuel efficiency and reduction in harmful exhaust emissions by comparison with the performance of the engine without the device attached. These results, of course, showed that the gas from the carburetor was substantially vaporized in the fuel vaporizer prior to being fed to the engine, although I am not entirely certain of the reasons for this vaporization. Obviously, however, air-fuel mixtures from the carburetor must travel roundabout paths to the intake manifold through the ports 30 and 32 in center plate 20, which means that there is more time for the gas in these mixtures to vaporize prior to entering the intake manifold than would be true in the absence of the fuel vaporizer. Another factor conducive to vaporization of the fuel in the fuel vaporizer is the fact that the paths of travel of the air-fuel mixtures are restricted where the mixtures pass through the ports 30 and 32, which means that the velocities of the mixtures increase, and their pressures drop, as they pass through these ports. As a result, vaporization of the fuel takes place under the lower pressures in the port areas. As the engine serviced by the vaporizer heats up in use, the parts of the vaporizer become warm from the engine heat and air-fuel mixtures contacting these parts absorb heat therefrom by conduction which serves to bring about further fuel vaporization.

For most of the time fuel vaporizer 10 is in service, air-fuel mixtures from the carburetor mounted thereon pass through both of the ports 30 and 32 on their way to the intake manifold of the engineto which it is attached. When the engine is idling, however, a major portion of the air-fuel mixture, I believe, passes through port 30, since this is the shortest route to the intake manifold and that port can handle most or all of the smaller volume of mixture involved at idling speeds. As the engine speeds up, more and more of the mixtures are diverted to the larger port 32, until, at high speeds, the major portion passes through that port. While I have found that two ports such as ports 30 and 32 are completely adequate for a fuel vaporizer designed for use on my (Dodge Coronet) car, it might be desirable to include additional openings through the center plate of the vaporizer where the latter is to be used on cars of larger engine size. For example, the center plate could be formed with a plurality of perforations between the openings in the top and bottom plates of the vaporizer, or in the area corresponding to that illustrated at 52 on center plate 20 in FIGS. 2 and 5. Any fuel vaporizer with such perforations, or other port openings, in addition to the two end openings corresponding to ports 30 and 32, is within the scope of my invention. The port opening sizes and positions in my novel fuel vaporizer can vary, depending upon the size and type of engine involved. To give a "ball park" idea of suitable sizes of such openings, I have found ¼" and ⅝" widths preferable for port openings corresponding to ports 30 and 32 of fuel vaporizer 10, respectively, for use on my Dodge Coronet engine. The attached drawings show a substantial reproduction of a fuel vaporizer with such port openings drawn to a reduced scale but proportionately identical in all respects to the model. From the drawings, therefore, the overall dimensions of the model can be roughly ascertained as evidence of the relatively small and compact size of the fuel vaporizer.

During the experimental phases of my work in arriving at the preferred form of fuel vaporizer in accordance with this invention, I constructed a plexiglass model of such a vaporizer and observed the manner in which the gasoline from a carburetor traveled through it to the intake manifold of an internal combustion engine while the engine was running at normal cruise speeds. I observed that the gasoline impinged the upper surface of the center plate of the vaporizer, then flowed toward the port openings in the ends of the partition between its upper and lower chambers. During this flow segment, the gasoline appeared to fractionate, the lighter fractions proceeding toward the port openings above the heavier fractions, and passing through those openings sooner than the latter. The heavier fractions seemed to swirl along the aforesaid partition until they reached the port openings, then after passing through the openings were no longer visible in swirling patterns. When both the lighter and heavier fractions reached the intake manifold opening, they were essentially gaseous. I do not profess to understand whether such fractionation brings about more effective vaporization of the fuel, but feel it might be helpful in greatly minimizing pollutant contamination of exhaust emissions from engines immediately after startup, particularly when they are cold at the time of starting. My reason for this opinion is, of course, the fact that the lighter gasoline fractions are cleaner-burning than their heavier counterparts, and these will reach the cold engine before the heavier fractions have traveled that far.

In any event, and regardless of how it brings about the desired results, the novel fuel vaporizers of my invention has been found to greatly reduce the amounts of harmful pollutants in engine exhausts while, at the same time, bringing about greatly enhanced fuel economy. Furthermore, I have ascertained that no choke or dashpot is necessary where my fuel vaporizer is employed with conventional carburetors, although there is no reason why such equipment should not be employed with the vaporizer. No catalytic converter would be necessary on an automobile employing the vaporizer, to the great advantage of automobile manufacturers and consumers alike because of monetary savings and performance improvements resulting from the elimination of such converters.

Following are examples showing how the fuel vaporizer of this invention reduces exhaust pollution and increases fuel economy of an internal combustion engine. It should, of course, be understood that these examples are included for illustrative purposes only.

EXAMPLE I

In this example, the 1969 Dodge Coronet engine referred to above was given a so-called baseline evaluation at Olsen Engineering Inc., a licensed vehicle test facility at Huntington Beach, Calif., to determine its exhaust emission characteristics and fuel economy. The car engine was tested on a dynamometer simulating city driving conditions (an average speed of 20 mph, including many stops and starts to simulate the conditions the average driver encounters going from home to work), without the fuel vaporizer attached. The test conditions were the same as those employed by the U.S. Environmental Protection Agency (EPA) in its laboratory when testing new cars to determine compliance with air pollution standards. The results of the baseline test are set forth below in Table I. Table I also includes, by way of comparison, the 1974 exhaust emission standards for light duty vehicles (both Federal and California standards, which are equivalent standards based on the 1975 CVS-II Federal Test Procedures).

Table I

| Origin | Exhaust Emissions Unburned Hydrocarbons (HC) | Carbon Monoxide (CO) | Nitrogen Oxide (NO) |
|---|---|---|---|
| My car (1969 Dodge Coronet) | 3.17 | 20.96 | 3.74 |
| Federal & California Emission Standards For 1974 | 3.4 | 39.0 | 3.0 |

Note: Quantities of pollutants are given in grams/mile

A comparison of the exhaust emissions from my car during the baseline test with the Federal and California emission standards for 1974 shows that the standards were exceeded in the case of hydrocarbons, the amount of carbon monoxide was little more than half the amount permitted by the standards, and the quantity of nitrogen oxide was almost low enough to meet the standards. These results show that the engine of my 1969 Dodge Coronet was extremely efficient, in spite of its age and the fact, previously mentioned, that it had 105,000 miles on it. As a result of data obtained during the baseline test, the fuel economy of the engine was found to be 16.12 miles per gallon. By way of comparison, the fuel economy for city driving conditions for a 1975 Dodge Coronet model corresponding to my Dodge Coronet was found by the EPA to be 11 miles per gallon (see the 1975 gas mileage guide for car buyers published jointly by the EPA and Federal Energy Administration, Sept. 1974), and for highway driving conditions, the fuel economy was determined to be 16 miles per gallon. The fuel economy for my 1969 car under city driving conditions (16.12 miles per gallon) was almost 50% greater than that of its 1974 counterpart, and even slightly in excess of the highway driving fuel economy for the 1975 car. These mileage comparisons, similarly to the emissions test results, demonstrate that my 6-year-old engine was extremely efficient in operation, in spite of it high (105,000) mileage.

EXAMPLE II

This example is a repetition of Example I, except that a fuel vaporizer in accordance with this invention was installed between the carburetor and intake manifold of the car engine prior to the dynamometer testing. The pollutant emissions results are tabulated below, along with the baseline test (Example I) data for purposes of comparison:

Table II

| Test | HC (grams/mile) | CO 8grams/mile) | NO (grams/mile) |
|---|---|---|---|
| With fuel vaporizer | 2.53 | 10.04 | 3.26 |
| Without fuel vaporizer | 3.17 | 20.96 | 3.74 |

From the Table II data, it can be determined that approximately 20% fewer unburned hydrocarbons, approximately 51% less carbon monoxide and about 12% less nitrogen oxide was present in the exhaust from the tested engine with the fuel vaporizer attached than from the engine without the vaporizer. This shows that the fuel vaporizer was remarkably effective in cleaning up the engine exhaust under city driving conditions. The results, in fact, show that the fuel vaporizer reduced the CO emission to only about two-thirds the 1975 and 1976 Federal standards for that pollutant (15.0), and almost brought the nitrogen oxide emission down to the 1975 requirement, which, incidentally, is the same for 1975 and 1976. With respect to the NO data, the reduction of that pollutant in the exhaust from the engine fitted with the fuel vaporizer was an unexpected surprise, since heretofore any reduction in hydrocarbons and carbon monoxide in engine exhausts had resulted in an NO increase in the exhaust. As those skilled in the art will appreciate, the ability of my fuel vaporizer to simultaneously cut down on NO at the same time it causes a reduction in HC and CO emissions is one of the key advantages of the present invention, and one which was totally unexpected from prior experimentation in the field. The fact that the tested engine was highly efficient to start with highlights the remarkable effectiveness of the fuel vaporizer in upgrading engine performance, since the less efficient the engine, the greater should be the upgrading effect of the fuel vaporizer.

In addition to being tested under city driving conditions, my car was tested, with the fuel vaporizer on the engine, under highway driving conditions (in accordance with the EPA procedure for such testing) and found to have a fuel economy of 21.22 miles per gallon. This compares very favorably with the 16 miles per gallon for the 1975 counterpart of my car, as determined by the EPA under highway driving conditions.

As will now be readily apparent, the fuel vaporizer of this invention is of extremely simple construction and capable of easy installation on a car engine by anyone capable of using a wrench. Thus, in the case of fuel vaporizer 10, which is a typical representative of the device, it is only necessary (after removal of the carburetor from the engine) to screw the studs 54 into the receptive openings for the carburetor anchoring studs on the engine, then place the fuel vaporizer in position so that the studs pass upwardly through stud holes 40 and 42 therein, and, finally, place the carburetor in position so that the upper ends of the studs pass through the stud holes in its base. After this, the nuts 50 are screwed onto the studs until all of the parts are fastened tightly together. Various means well known to those skilled in the art, such as gaskets, sealants, and the like, can be employed to insure against the escape of liquid or gaseous fluids from the assembly. It is preferred not to employ a gasket between the fuel vaporizer and the engine, however, since such a gasket would tend to insulate the body of the fuel vaporizer from the conduction of heat from the intake manifold, and, as indicated above, such heat is of some advantage in insuring more effective vaporization of the gas in the vaporizer.

While my novel fuel vaporizer has been herein described and illustrated in what I consider to be a preferred embodiment, it will be appreciated by those skilled in the art that my invention is not limited to that particular embodiment, but is broad enough in concept to encompass all modifications thereof incorporative of the structural and functional essence of the invention as taught herein. Some of these modifications have been previously discussed, and others will be evident to those skilled in the art in the light of present teachings. In FIG. 1 of the drawings, fuel vaporizer 10 is shown attached to an 8-cylinder V-8 engine, with its longitudinal axis parallel to that of the engine. This is not the only way of installing the vaporizer, however, and the device can vary in noncritical respects from that illustrated to tailor it for use in conjunction with any of various makes and types of internal combustion engines. For some engines, for example, the device can be made for installation with its longitudinal axis at right angles to the engine axis.

In summary, it is emphasized that the present invention includes within its scope all variant forms thereof encompassed by the language of the following claims.

What I claim is:

1. Vaporizing means particularly adapted for use in converting wet mixtures of fuel and air from the jets of a carburetor for an internal combustion engine to substantially dry mixtures, said vaporizer means comprising:

a body formed of a thermally conductive material having a relatively flat elongate first internal chamber, a relatively flat, elongate second internal chamber in superposed relationship with the first internal chamber and a relatively thin partition separating the two chambers;

said body having a first opening into said first internal chamber and a second opening into said second internal chamber;

said partition having a first port interconnecting the first and second internal chambers and a second port interconnecting said chambers;

the first and second openings in said body being of equal size and shape and in peripheral and axial alignment, said first port being offset a first distance in one longitudinal direction from the aligned axes of said first and second openings, and said second port being offset a second distance in the opposite longitudinal direction from said axes;

said body being sized and shaped, and its openings and chambers being positioned and otherwise adapted, to permit its interposition between said carburetor and said internal combustion engine in a way to receive air-fuel mixtures from the carburetor jets through said first opening, and discharge said mixtures, after they have passed through at least one of the ports in said partition, into the intake manifold of the engine through said second opening;

whereby the air-fuel mixtures are detoured through said body between the carburetor and intake manifold, when the engine is running, and undergo increases in velocity when passing through one or both of said ports and, additionally, absorb engine heat through the thermally conductive material of the body so that vaporization of fuel droplets in the mixture takes place to render said fuel more completely combustible in said engine.

2. Vaporizer means in accordance with claim 1 in which said first port is closer to said axes than said second port.

3. Vaporizer means in accordance with claim 2 in which the first and second ports are transverse slots at opposite ends of said partition.

4. Vaporizer means in accordance with claim 3 in which said transverse slots are of equal length and the space relationship of said aligned axes and the axes of said ports is such that the first port is approximately one-half the distance from said aligned axes as is the second port and is of substantially half the width of said second port.

5. Vaporizer means in accordance with claim 4 in which said thermally conductive material is aluminum.

* * * * *